US006054022A

United States Patent [19]

Helwig et al.

[11] Patent Number: 6,054,022

[45] Date of Patent: Apr. 25, 2000

[54] METHOD FOR PRODUCING A NON-WOVEN GLASS FIBER MAT COMPRISING BUNDLES OF FIBERS

[75] Inventors: Gregory S. Helwig, Granville, Ohio; Vallipuram Pathmanathan, Bradford; Robert W. Heseltine, Guideley, both of United Kingdom

[73] Assignees: Owens-Corning Veil U.K. Ltd., Liversedge, United Kingdom; Owens Corning Fiberglas Technology, Inc., Summit, Ill.

[21] Appl. No.: 09/036,519

[22] Filed: Mar. 6, 1998

Related U.S. Application Data

[63] Continuation-in-part of application No. 08/712,711, Sep. 12, 1996, abandoned.

[51] Int. Cl.[7] ..... D21H 13/38

[52] U.S. Cl. ..... 162/156; 162/158; 162/164.1; 162/164.3; 162/168.3; 162/177

[58] Field of Search ..... 162/156, 158, 162/145, 179, 177, 178, 168.1, 168.3, 100, 164.1, 164.3

[56] References Cited

U.S. PATENT DOCUMENTS

| | | |
|---|---|---|
| 3,716,449 | 2/1973 | Gatward et al. . |
| 3,871,952 | 3/1975 | Robertson . |
| 4,112,174 | 9/1978 | Hannes et al. . |
| 4,118,272 | 10/1978 | Ziegler et al. . |
| 4,129,674 | 12/1978 | Hannes et al. . |
| 4,179,331 | 12/1979 | Chakrabarti . |
| 4,242,404 | 12/1980 | Bondoc et al. . |
| 4,265,704 | 5/1981 | Nahta . |
| 4,324,495 | 4/1982 | Martinez . |
| 4,370,169 | 1/1983 | Graham . |
| 4,395,306 | 7/1983 | Killat . |
| 4,690,860 | 9/1987 | Radvan et al. . |
| 4,869,932 | 9/1989 | Romberger . |
| 4,882,114 | 11/1989 | Radvan et al. . |
| 5,308,692 | 5/1994 | Kennedy et al. . |
| 5,389,716 | 2/1995 | Graves . |
| 5,393,379 | 2/1995 | Parrinello . |
| 5,409,573 | 4/1995 | Weeks . |
| 5,462,642 | 10/1995 | Kajander . |

*Primary Examiner*—Peter Chin
*Attorney, Agent, or Firm*—Inger H. Eckert

[57] ABSTRACT

A method is provided for forming a wet-laid nonwoven glass fiber mat comprised of a plurality of bundles of fibers. The method includes the steps of adding chopped fibers to a water slurry containing a sufficient amount of a suitable hydrophobic agent to cause the fibers to form a plurality of bundles. The fibers are then formed into a mat which may be used in a number of reinforcement applications. A method is also provided for modifying the components in the water slurry to produce mats comprising either bundles of fibers or dispersed fibers.

31 Claims, 2 Drawing Sheets

METHOD FOR PRODUCING A NON-WOVEN GLASS FIBER MAT COMPRISING BUNDLES OF FIBERS

BACKGROUND OF THE INVENTION

This is a continuation-in-part application of U.S. patent application Ser. No. 08/712,711, filed Sep. 12, 1996, now abandoned, the disclosure of which is hereby incorporated by reference.

The present invention relates to a process for producing a non-woven glass fiber mat, and more particularly, to a wet-laid process for forming a glass fiber mat comprised of small bundles of glass fibers.

Many methods are known for producing glass fiber mats for use in a variety of applications. Two well-known methods are wet-laid processing and dry-laid processing. Typically, in a wet-laid process, a water slurry is provided into which the fibers are dispersed. The water slurry may contain surfactants, viscosity modifiers, defoaming agents, or other chemical agents. Chopped fibers are then introduced into the slurry and agitated such that the fibers become dispersed. The slurry containing the fibers is then deposited onto a moving screen, and a substantial portion of the water is removed to form a web. A binder is then applied, and the resulting mat is dried to remove the remaining water and to cure the binder. The resulting non-woven mat consists of an assembly of dispersed, individual glass filaments as shown in FIG. 1. Such a wet-laid process is preferred in applications where a very uniform distribution of fibers is desired.

Another method of forming glass fiber mats is a dry-laid process in which the resulting mats are comprised of bundles of fibers (i.e., multiple fibers associated closely together in substantially parallel relationship). In a typical dry-laid process, fibers are chopped and air blown onto a conveyor, and a binder is then applied to form the mat. A dry-laid process is desirable in instances where an open structure is desired in the resulting mat to allow the rapid penetration of viscous liquids or resins, or in applications where it is desirable to minimize the volume of the glass fibers. However, such dry-laid processes have a disadvantage in that the resulting mats are of a nonuniform weight when compared with mats produced by a wet-laid process, i.e., different areas of the mats have different weights. This is especially true for lightweight mats having a basis weight of 200 g/m$^2$ or less. In addition, the use of dry-chopped input fibers is more expensive than the use of wet-chopped input fibers because the fibers in a dry-laid process are dried and packaged in separate steps before being chopped offline, while wet-chopped fibers are applied with sizing and then chopped directly.

For certain reinforcement applications in the formation of molded parts using polymer resins, it would be desirable to form fiber mats in which the mat comprises bundles of fibers (as in a dry-laid process) and yet has a uniform weight. Wet-laid processes are known in which glass mats are produced which include bundles of glass fibers. For example, U.S. Pat. No. 4,242,404 to Bondoc describes a process in which bundles or "strings" of fibers are formed along with individual fibers. Hannes, U.S. Pat. No. 4,112,174 also teaches a process for forming a mat comprising individual glass fibers and glass fibers bundles, where the bundles are held together by the use of a water insoluble binder. However, such mats are unsuitable for applications in which high porosity is desired because the resulting mat still includes dispersed fibers along with the bundles. Further, the process of Bondoc produces bundles of long fibers which detract from the appearance of the final molded part in reinforcement applications as such fibers are visible in the resulting part.

Accordingly, there is still a need in the art for a process for producing lightweight glass fiber mats which are uniform in weight comprised of bundles of fibers, which may be economically produced, and which have an open, porous structure for use in the production of reinforced molded parts.

SUMMARY OF THE INVENTION

The present invention meets that need by providing a method of forming a wet-laid glass fiber mat in which the components in the water slurry may be modified so as to cause the fibers to form discrete bundles of closely associated multiple fibers in a substantially parallel relationship. The resulting mat may comprise small or large bundles of fibers, is of a uniform weight, and has a porous structure. By uniform weight, it is meant that there is a uniform distribution of fiber weight within the mat. In addition, the process is economical as it utilizes low-cost standard wet-chopped fibers.

According to one aspect of the invention, a method of forming a wet-laid glass fiber mat is provided which includes the steps of adding chopped glass fibers to an aqueous slurry containing a surfactant and a viscosity modifier, agitating the fibers to cause them to disperse, removing water from the fibers to form a web, and applying a binder to the web to form a glass fiber mat.

The surfactant contained in the slurry is preferably a cationic surfactant which is present in an amount of from about 30 to about 200 ppm. The surfactant functions to lubricate the fibers and aid in dispersion of the fibers when they are initially placed in the slurry. The viscosity modifier is preferably hydroxyethyl cellulose, which is present in an amount of about 2000 ppm. The viscosity modifier maintains a highly viscous aqueous slurry which helps facilitate agitation and allows control of water drainage when water is removed from the fibers.

The method of forming the mat also includes the step of adding a sufficient amount of a suitable hydrophobic agent to the slurry to cause the chopped fibers to form bundles in the slurry. By hydrophobic agent, we mean a composition which is attracted to the surface of the fibers and which repels water and which exhibits the proper balance of hydrophilic and lipophilic properties, as defined by their hydrophilic/lipophilic balance (HLB) value. The hydrophobic agent preferably comprises a polyalkoxane defoaming agent which is added to the slurry in an amount of from about 300 to about 1000 ppm.

The method may further optionally include the step of adding a complexing agent for the surfactant to the slurry. The complexing agent functions to tie up the surfactant, thus aiding in fiber bundle formation. Preferably, the complexing agent is a polycarboxylate salt, which is added in an amount of from about 20 to about 100 ppm.

Preferably, the method also includes the step of drying the mat after application of the binder. The resulting non-woven glass fiber mat comprises bundles of chopped fibers. Preferably, the chopped fibers used in the present invention are wet-chopped fibers having a length of from about 3 mm to about 50 mm, and more preferably, from about 25 mm to about 50 mm.

The size of the bundles in the resulting mat is preferably from about 50 to about 500 fibers and is controlled by the amount of the hydrophobic agent in the slurry. For purposes of the present invention, small bundles comprise about 50 individual filaments, while larger bundles may be defined as those comprising from about 300 to about 500 individual filaments.

The non-woven glass fiber mat preferably has a basis weight of from about 40 to about 500 g/m$^2$, and more preferably, from about 60 to about 300 g/m$^2$. The thickness of the mat is typically thinner than wet-laid mats comprised of dispersed fibers, but may vary depending on the bundle size. For example, smaller bundles produce thicker mats, while larger bundles produce thinner mats.

The method of the present invention provides an advantage over prior processes in that the components in the slurry which cause or aid in bundle formation may be easily modified to form mats comprising dispersed fibers (i.e., having substantially no fiber bundles). This can be done without having to drain the aqueous slurry from the machine or mixing tank in which the fibers are processed, which results in a substantial savings in time and cost. For example, in another embodiment of the invention, a method is provided for modifying the components in the aqueous slurry which includes the steps of providing an aqueous slurry containing a surfactant, a viscosity modifier and wet-chopped fibers, and adding a sufficient amount of a suitable hydrophobic agent to cause the fibers to form a plurality of bundles. A mat is then formed as described above by removing water from the fibers to form a web and applying a binder to the web.

When the formation of mats with bundled fibers is no longer desired, the method may include the step of adding a sufficient amount of a surfactant to the existing slurry which causes the fibers to disperse. A mat comprising dispersed fibers may then be produced by removing water from the fibers to form a web and applying a binder. The surfactant is preferably added to the slurry in an amount so as to obtain a level of from about 30 ppm to about 200 ppm.

In the embodiment where bundled fibers are desired, a complexing agent for the surfactant such as a polycarboxylate salt may be added to the slurry with the hydrophobic agent which aids in bundle formation as described above. Where the complexing agent is included in the slurry, the slurry may be modified by the addition of a cationic polyacrylamide, which functions to remove the complexing agent and causes the fibers to disperse. The cationic polyacrylamide is preferably added in an amount of from about 25 to about 50 ppm.

In yet another embodiment of the invention, a method is provided for forming a wet-laid glass fiber mat comprising the steps of adding chopped glass fibers to an aqueous slurry, adding a sufficient amount of a suitable hydrophobic agent to the slurry to cause the chopped fibers to form a plurality of bundles, and forming a mat as described above. In this embodiment, the aqueous slurry does not contain a surfactant.

The hydrophobic agent added to the slurry may comprise a polyalkoxane defoaming agent, and is preferably added to the slurry in an amount of from about 50 to about 1000 ppm. In this embodiment, the slurry may also contain from about 30 to about 3000 ppm of a viscosity modifier selected from the group consisting of hydroxyethyl cellulose, anionic polyacrylamide, and polyethylene oxide.

Alternatively, the hydrophobic agent added to the slurry may comprise a viscosity modifier. Preferably, the viscosity modifier comprises an anionic polyacrylamide in the form of a water-in-oil emulsion, and is added to the slurry in an amount of from about 30 to about 1000 ppm. In this embodiment, it is the combination of the oil and emulsifier that causes bundle formation.

Accordingly, it is a feature of the present invention to provide a method for producing a wet-laid glass fiber mat comprised of a plurality of bundles of fibers in which the fibers are formed into bundles by the addition of a suitable hydrophobic agent to an aqueous slurry. It is a further feature of the invention to provide a method of modifying the aqueous slurry components in a wet-laid process to form fiber mats comprised of either bundles of fibers or dispersed fibers. These, and other features and advantages of the present invention will become apparent from the following detailed description, the accompanying drawings, and the appended claims.

DETAILED DESCRIPTION AND PREFERRED EMBODIMENTS OF THE INVENTION

Figure 1:
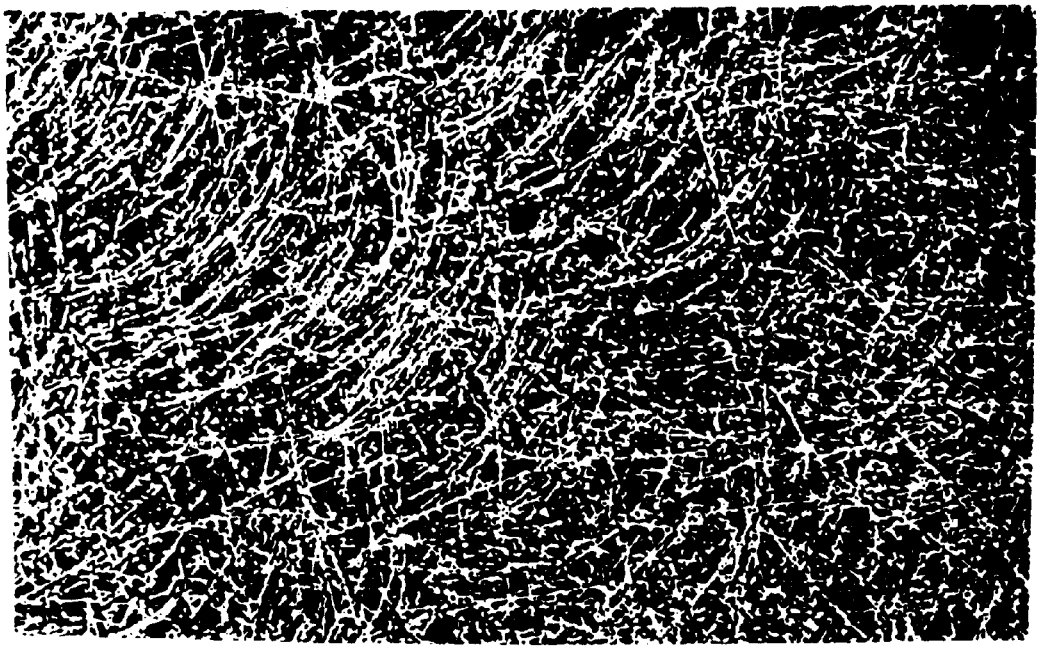
FIG. 1 is an enlarged perspective view of a glass fiber mat comprised of dispersed fibers.

The process of the present invention provides many advantages over prior art mats which are formed by a dry-laid process. The wet-laid process of the present invention provides a highly porous, thin, non-woven glass fiber mat which has greater uniformity of fiber distribution than mats produced in dry-laid processes. Further, the mat of the present invention can be produced at lower cost because it uses low-cost wet chopped fibers which are formed into bundles by altering the components of the slurry used in a normal wet-laid process. In addition, the slurry components may be modified so as to produce mats comprising either bundles of fibers or dispersed fibers without having to replace the entire slurry.

The wet-laid mat of the present invention may be processed with the use of papermaking-type machines such as Fourdrinier, wire cylinder, Stevens Former, Roto Former, Inver Former and Venti Former machines. The general procedure for preparing the glass fiber mat of the present invention is to form an aqueous slurry which contains the desired hydrophobic agent, and which may further contain a surfactant, a viscosity modifier, and a complexing agent. The amount of water in the slurry may vary depending on the size of the equipment used. Typical volumes of water may range from 40,000 to 80,000 liters. Wet chopped fibers are added to the slurry and agitated to form a thick stock. During agitation, the fibers begin to form bundles. Preferably, the concentration of fibers in the slurry is maintained at from about 0.2% by weight to about 1% by weight.

The fiber-containing slurry is then passed to a conventional head box where the the slurry is deposited onto a moving wire screen and dewatered by suction or vacuum to form a web comprising bundles of fibers. The web is coated with a binder by conventional means and then passed through a drying oven which dries the mat and cures the binder. One suitable binder is an emulsion of a copolymer of ethylene and vinyl acetate. However, it should be appreciated that the choice of binder will depend on the end use. Any binder which is suitable for use in a wet-formed mat operation may be used in the present invention.

In the embodiment in which the hydrophobic agent comprises a polyalkoxane defoaming agent, a preferred defoaming agent is Dispelair CF707, available from Blackburn Chemicals Ltd.

An alternative hydrophobic agent which may be used in embodiments where the slurry does not contain a surfactant is an anionic polyacrylamide viscosity modifier which is in the form of a water-in-oil emulsion. A preferred anionic polyacrylamide viscosity modifier is Magnifloc 1885A, available from Cytec Industries.

While the above-described hydrophobic agents are preferred for use in the present invention, it should be appreciated that other hydrophobic agents may be used as long as they have the proper balance of hydrophilic and lipophilic properties, being attracted to the fibers such that it coats the fibers and causes them to become hydrophobic and repel the water, gathering together to form bundles. The balance of hydrophilic and lipophilic properties is often expressed numerically using the hydrophilic/lipophilic scale. This scale assigns a value of 1 to the most hydrophobic surfactants with increasing values for the more hydrophilic surfactants. Surfactants with values of 18 and above are quite hydrophilic and therefore substantially soluble in water. Hydrophobic agents suitable for use in the present invention are typically characterized as having a hydrophilic/lipophilic balance (HLB) value of from about 1 to about 15, preferably from about 1 to about 10, and more preferably from about 1 to about 7.

In embodiments where the slurry contains a surfactant, a preferred cationic surfactant is Aerosol C-61, available from Cytec Industries. In such embodiments, the addition of a complexing agent to the slurry is preferred. A suitable complexing agent is a polycarboxylate salt. A preferred polycarboxylate salt is available under the designation Dispex N40V from Allied Colloids. The polycarboxylate salt functions to complex with the surfactant in the slurry so that the surfactant is prevented from emulsifying the hydrophobic agent. This, in turn, prevents the fibers from dispersing, thus aiding the hydrophobic agent in forming fiber bundles. It should be noted that while fiber bundles may be formed without the use of the polycarboxylate salt, much higher amounts of the hydrophobic agent would be required, i.e., about 3000 ppm to about 5000 ppm.

Figure 2:
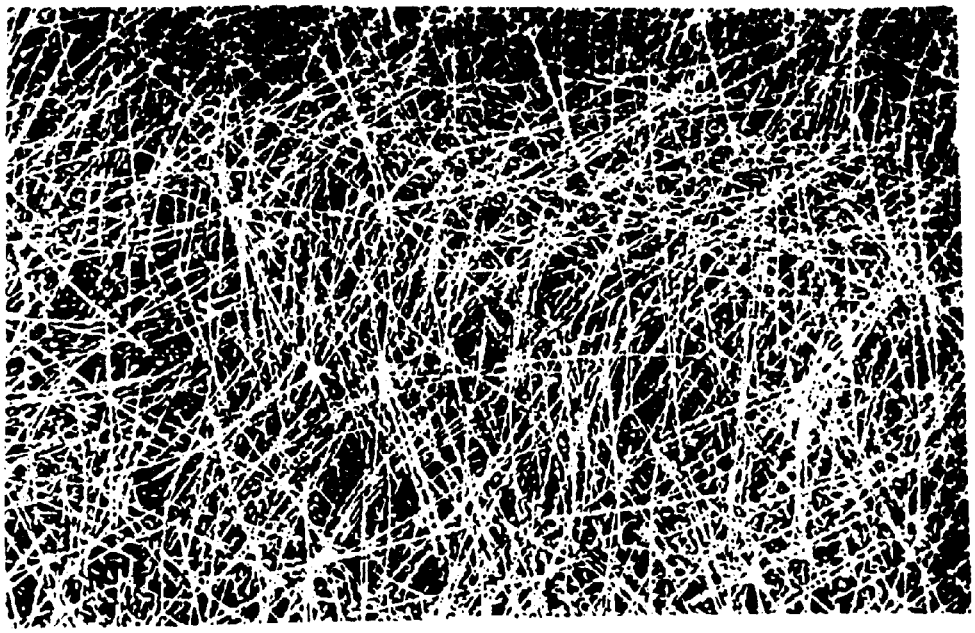
FIG. 2 is an enlarged perspective view of a glass fiber mat comprised of small bundles of fibers formed in accordance with the present invention.
Figure 3:
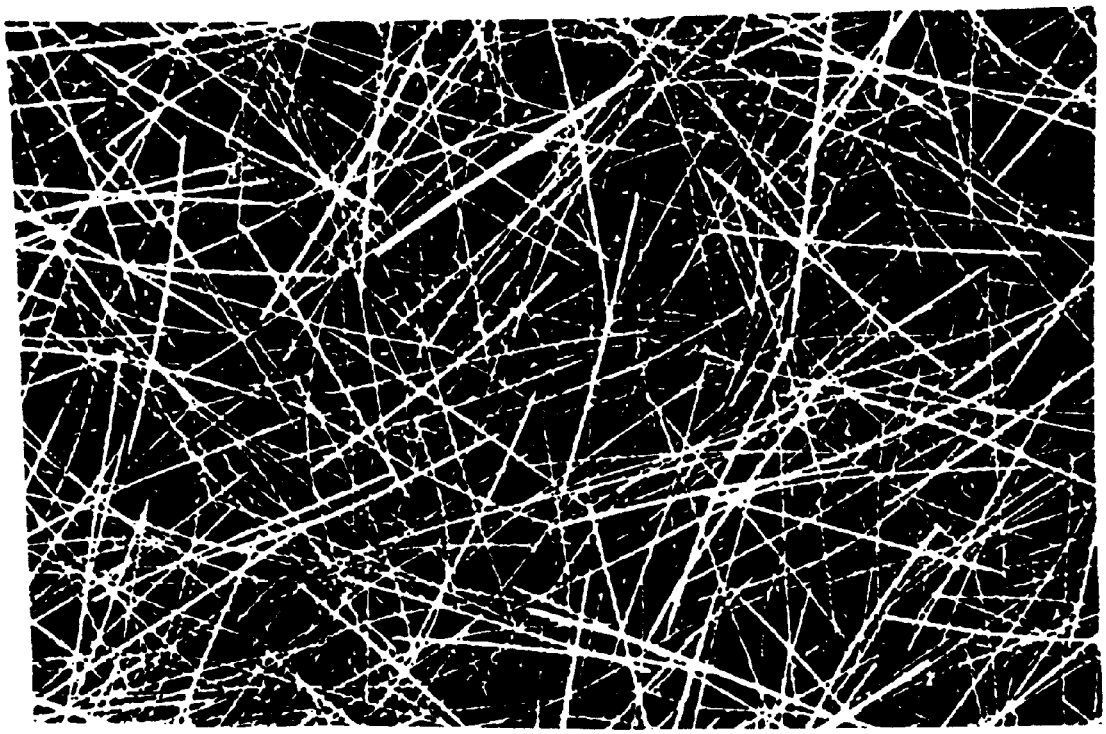
FIG. 3 is an enlarged perspective view of a glass fiber mat comprised of large bundles of fibers formed in accordance with the present invention.

The complexing agent also works with the hydrophobic agent to control the size of the bundles formed. For example, when about 50 ppm of a polycarboxylate salt is added to the water slurry along with 300 ppm of a polyalkoxane defoaming agent, small bundles of fibers are formed as shown in FIG. 2. As the level of defoaming agent is increased from 300 ppm to about 700 ppm, the bundle size increases as shown in FIG. 3 to a maximum size that is reached with about 1000 ppm of the defoaming agent. In embodiments where the slurry contains a viscosity modifier for the purpose of regulating the slurry viscosity, suitable viscosity modifiers include hydroxyethyl cellulose, anionic polyacrylamide, and polyethylene oxide. A preferred viscosity modifier is Natrosol 250 HHBR (hydroxyethyl cellulose) available from Aqualon Co.

Preferably, the chopped glass fibers used in the present invention are wet-chopped fibers having a length of from about 3 mm to about 50 mm, and more preferably, from about 25 mm to about 50 mm. We have found that fibers which are too long in length tend to form strings, while fibers which are too short will not provide a strong enough web when the fibers are gathered. If molded into parts, the irregular shape of the bundles formed from fibers which are too long may "print-through" the surface of the molded part, resulting in a nonuniform surface having visible fibers.

The fibers should preferably have a diameter of about 16 to about 25 microns. The diameter of the fiber determines the acceptable chop length, i.e., the larger the fiber diameter, the longer the acceptable chop length up to a maximum of 50 mm with 25 micron fibers.

A wide range of sizing agents may be used on the fibers. However, sufficient time must be allowed for the sizing to wash off the fibers when they are placed in the slurry. This time may vary depending on the temperature of the slurry and the degree of agitation of the slurry after fiber addition, as well as the composition of the sizing used on the fibers. For example, the temperature of the slurry is typically in the range of from about 20° C. to about 40° C., and it usually takes from about 5 to 15 minutes for the size to wash off and for the bundles to form. When the temperature of the slurry is lower, the sizing usually takes longer to wash off. We have found that when the sizing on the fibers contains the Aerosol C-61 surfactant, the surfactant effectively washes off the fibers during agitation of the slurry and becomes complexed with the polycarboxylate salt.

The resulting mat comprising bundles of fibers may be used in a number of different applications. For example, the mat may be used in the reinforcement of polyurethane foam headliners. The wet-laid mats may also be used in reinforced plastics applications such as in the production of boat hulls or food service trays.

The wet-laid process of the present invention provides an advantage in that the components in the aqueous slurry may be modified so as to produce mats comprised of either bundles or dispersed fibers without having to drain the slurry from the machine. For example, when it is no longer desirable to produce bundled fibers with the addition of a hydrophobic agent, a sufficient amount of a surfactant may be added to the slurry which emulsifies the hydrophobic agent and allows the fibers to disperse. The surfactant is preferably added to the slurry to obtain a level of about 30 to about 200 ppm.

In embodiments where the slurry contains a polycarboxylate salt with the hydrophobic agent, the slurry may be modified by the addition of a cationic polyacrylamide. The cationic polyacrylamide effectively removes the polycarboxylate salt from the slurry such that the surfactant can effectively disperse the fibers. A preferred cationic polyacrylamide is Percol 1597 available from Allied Colloids. The amount added to the slurry is preferably about 25 to about 50 ppm, but may be varied depending on how much of the polycarboxylate salt is present in the slurry. We have found that an excess of the cationic polyacrylamide may be added without adversely affecting the aqueous slurry.

In order that the invention may be more readily understood, reference is made to the following examples, which are intended to be illustrative of the invention, but are not intended to be limiting in scope.

EXAMPLE 1

An aqueous mixture was formed in a wet-process pilot machine containing 2000 ppm of Natrosol 250 HHBR (hydroxyethyl cellulose viscosity modifier from Aqualon Co.), 75 ppm Aerosol C-61 surfactant (Cytec Industries), and 50 ppm of Dispelair CF-707 defoaming agent (Blackburn Chemicals Ltd.). The viscosity was measured at 8.0 cps at a temperature of about 26° C. Throughout the formation of the mat, the viscosity was maintained in the range of 8.0 to 8.5 cps by periodic addition of a 0.5 percent solution of Natrosol 250 HHBR in water. The line speed was maintained at 9.1 m/min (30 fpm).

A slurry of 4394 g of 23$\mu$×37 mm R51 wet-chopped glass fibers (Owens Corning) in 2000 l. of the aqueous mixture formed above was stirred with moderate agitation for ten minutes. This thick stock was then transferred to the machine at a flow rate of about 68 l./min (18 gpm). The thick stock was diluted with additional aqueous mixture so that the total flow to the headbox was about 1135 l./min (300 gpm). An excellent dispersion of fibers was obtained. The sheet was then dewatered and transferred to a saturator section where a binder comprising a vinyl acetate-ethylene emulsion (Airflex 124 from Air Products) was applied at a 20% solids basis concentration. The wet, binder saturated sheet was then transferred to an oven where it was dried and the binder cured. The resulting mat had a basis weight of 60 g/m$^2$ and a binder content of 14.4%. The mat thickness was 0.6 mm.

EXAMPLE 2

A slurry mix tank was charged with 2000 l. of the aqueous mixture described in Example 1 with an additional 50 ppm of Aerosol C-61 surfactant and 10 ppm of Dispelair defoaming agent. 10 ppm of Dispex N40V (sodium salt of polycarboxylic acid from Allied Colloids) was then added. A 6590 g charge of wet-chopped fibers was then added and stirred for 15 minutes. A mat was then formed as described above. The resulting mat contained a combination of dispersed fibers and "strings".

EXAMPLE 3

Using the slurry formed in Example 2, the amount of Dispex in the slurry mix tank was increased to 50 ppm, with the other components remaining at the previous level. A mat was formed in which more strings appeared.

EXAMPLE 4

Using the slurry formed in Example 3, the level of Dispelair was increased to 500 ppm, with the other components remaining at the same level. The resulting mat consisted entirely of small, slightly elongated fiber bundles. The resulting mat had a thickness of about 0.4 mm, had a basis weight of 90 g/m$^2$, and a binder content of 10.2%.

EXAMPLE 5

Using the slurry formed in Example 4, the amount of Dispelair was increased to 700 ppm, which produced a mat with larger bundles of fibers.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. In a method for forming a wet-laid glass fiber mat which includes the steps of adding wet-chopped glass fibers to an aqueous mixture containing a surfactant and a viscosity modifier, thereby forming a slurry, agitating the fibers to cause them to disperse, removing water from said fibers to form a web, and applying a binder to said web to form said glass fiber mat, the improvement comprising the step of adding a sufficient amount of a suitable hydrophobic agent, having an HLB value of from about 1 to about 15, to said slurry to cause said chopped fibers to form bundles in said slurry.

2. The method of claim 1 in which said hydrophobic agent has an HLB value of from about 1 to about 10.

3. The method of claim 1 in which said hydrophobic agent comprises a polyalkoxane defoaming agent.

4. The method of claim 3 wherein the polyalkoxane defoaming agent has an HLB value of from about 1 to 10.

5. The method of claim 1 in which from about 300 to about 1000 ppm of said hydrophobic agent is added to said slurry.

6. The method of claim 3 in which said surfactant comprises from about 30 to about 200 ppm of a cationic surfactant.

7. The method of claim 1 in which said viscosity modifier comprises about 2000 ppm hydroxyethyl cellulose.

8. The method of claim 1 further comprising the step of adding a complexing agent for said surfactant to said slurry.

9. The method of claim 8 in which said complexing agent comprises a polycarboxylate salt.

10. The method of claim 8 in which from about 20 to about 100 ppm of said complexing agent is added to said slurry.

11. The method of claim 1 including the step of drying said mat after application of said binder.

12. The method of claim 1 in which said chopped fibers have a length of from about 3 mm to about 50 mm.

13. The method of claim 1 in which said chopped fibers have a length of from about 25 mm to about 50 mm.

14. The method of claim 1 in which the bundle size is from about 50 to about 1000 fibers.

15. The method of claim 1 including the step of controlling the size of said bundles by controlling the amount of said hydrophobic agent added to said slurry.

16. A wet-laid method to produce non-woven glass fiber mats comprised of bundles of glass fibers comprising the steps of:

providing an aqueous slurry containing a surfactant, a viscosity modifier, and wet-chopped fibers;

adding a sufficient amount of a suitable hydrophobic agent, having an HLB value value of from about 1 to about 15, to said slurry to cause said fibers to form a plurality of bundles;

removing water from said fibers to form a web; and applying a binder to said web to form said glass fiber mat.

17. The method of claim 16 further including the steps of adding a sufficient amount of a surfactant to said slurry to cause said fibers to disperse, removing water from said fibers to form a web, and applying a binder to said web to form a glass fiber mat comprising dispersed fibers.

18. The method of claim 17 in which said surfactant is added to said slurry in an amount to reach a level of from about 30 ppm to about 200 ppm.

19. The method of claim 16 in which a complexing agent for said surfactant is added to said slurry with said hydrophobic agent.

20. The method of claim 19 in which said complexing agent comprises a polycarboxylate salt.

21. The method of claim 19 further including the step of adding a sufficient amount of a cationic polyacrylamide to said slurry to cause said fibers to disperse, removing water from said fibers to form a web, and applying a binder to said web to form a glass fiber mat comprising dispersed fibers.

22. The method of claim 21 in which about 25 to about 50 ppm of said cationic polyacrylamide is added to said slurry.

23. A method of forming a wet-laid glass fiber mat comprising the steps of:

adding chopped glass fibers to an aqueous mixture, thereby forming a slurry;

adding a sufficient amount of a suitable hydrophobic agent, having an HLB value of from about 1 to about 15, to said slurry to cause said chopped fibers to form a plurality of bundles;

removing water from said fibers to form a web; and applying a binder to said web to form a mat.

24. A method of claim 23 wherein said hydrophobic agent has an HLB value of from about 1 to about 10.

25. The method of claim 23 in which said hydrophobic agent comprises a viscosity modifier.

26. The method of claim 25 in which said viscosity modifier comprises an anionic polyacrylamide in the form of a water-in-oil emulsion.

27. The method of claim 23 in which from about 30 to about 1000 ppm of said hydrophobic agent is added to said slurry.

28. The method of claim 23 in which said hydrophobic agent comprises a polyalkoxane defoaming agent.

29. The method of claim 28 in which from about 50 to 1000 ppm of said hydrophobic agent is added to said slurry.

30. The method of claim 28 in which said slurry further contains from about 30 to about 3000 ppm of a viscosity modifier.

31. The method of claim 30 in which said viscosity modifier is selected from the group consisting of hydroxyethyl cellulose, anionic polyacrylamide, and polyethylene oxide.

* * * * *